US008443912B2

(12) United States Patent
Fischer et al.

(10) Patent No.: US 8,443,912 B2
(45) Date of Patent: May 21, 2013

(54) HAND-HELD POWER TOOL

(75) Inventors: Axel Fischer, Wiedergeltingen (DE); Roland Meuer, Ettringen (DE); Michael Weber, Eichenau (DE)

(73) Assignee: Hilti Aktiengesellschaft, Schaan (LI)

( * ) Notice: Subject to any disclaimer, the term of this patent is extended or adjusted under 35 U.S.C. 154(b) by 661 days.

(21) Appl. No.: 12/069,951

(22) Filed: Feb. 13, 2008

(65) Prior Publication Data

US 2008/0202785 A1 Aug. 28, 2008

(30) Foreign Application Priority Data

Feb. 15, 2007 (DE) ..... 10 2007 000 093

(51) Int. Cl.
*B25D 17/04* (2006.01)

(52) U.S. Cl.
USPC ..... 173/162.2; 173/162.1

(58) Field of Classification Search
USPC ..... 173/162.1, 162.2
See application file for complete search history.

(56) References Cited

U.S. PATENT DOCUMENTS

| | | | | |
|---|---|---|---|---|
| 4,673,043 | A * | 6/1987 | Greppmair | 173/162.2 |
| 4,749,049 | A | 6/1988 | Greppmair | |
| 5,025,870 | A | 6/1991 | Gantner | |
| 6,076,616 | A * | 6/2000 | Kramp et al. | 173/162.2 |
| 6,148,930 | A * | 11/2000 | Berger et al. | 173/162.2 |
| 6,286,610 | B1 * | 9/2001 | Berger et al. | 173/162.1 |
| 6,948,570 | B2 * | 9/2005 | Kristen et al. | 173/162.1 |
| 6,962,211 | B2 * | 11/2005 | Daubner et al. | 173/162.2 |
| 7,500,527 | B2 * | 3/2009 | Fischer et al. | 173/162.2 |
| 7,527,107 | B2 * | 5/2009 | Berger et al. | 173/162.2 |
| 2003/0037937 | A1 * | 2/2003 | Frauhammer et al. | 173/48 |
| 2004/0154813 | A1 | 8/2004 | Daubner et al. | |
| 2006/0086515 | A1 | 4/2006 | Engelfried et al. | |
| 2006/0144604 | A1 * | 7/2006 | Soika et al. | 173/162.2 |
| 2006/0185867 | A1 | 8/2006 | Frauhammer et al. | |
| 2007/0034396 | A1 * | 2/2007 | Berger et al. | 173/162.2 |
| 2007/0034397 | A1 * | 2/2007 | Fischer et al. | 173/162.2 |
| 2008/0000664 | A1 * | 1/2008 | Steinke | 173/162.2 |
| 2008/0073095 | A1 * | 3/2008 | Henriksson et al. | 173/162.2 |
| 2009/0223693 | A1 * | 9/2009 | Aoki | 173/211 |

FOREIGN PATENT DOCUMENTS

| | | |
|---|---|---|
| DE | 0332109 | 2/2005 |
| EP | 1637288 | 3/2006 |
| EP | 1674210 | 6/2006 |
| WO | 2006004547 | 1/2006 |
| WO | WO 2006022345 A1 * | 3/2006 |

* cited by examiner

*Primary Examiner* — Brian D Nash
(74) *Attorney, Agent, or Firm* — Abelman, Frayne & Schwab

(57) ABSTRACT

A hand-held power tool (2) has a base housing (4) in which there is provided an operational unit (12) movable in a reciprocating manner along a operational axis (A) defining a first spatial axis (z) and spaced from a center of gravity (SP) of the hand-held power tool (2) in direction of a second spatial axis (y) which is perpendicular to the first spatial axis, (z), and further has a cover housing (18) which is held on the base housing (4) by decoupling elements and is fixedly connected to a main handle (24) and to side-handle connection element (28), with the decoupling elements having, in a projection perpendicular to a plane (Eyz) defined by the first spatial axis (z) and the second spatial axis (y), a first support device (19) which is located adjacent to the center of gravity and which holds the cover housing (18) on the base housing (4) so as to be displaceable along and pivotal in direction of the first spatial axis (z).

16 Claims, 7 Drawing Sheets

HAND-HELD POWER TOOL

BACKGROUND OF THE INVENTION

1. Field of the Invention

The present invention relates to a hand-held power tool having base housing in which there is provided operational means that reciprocates in operation along an operational axis defining a first virtual spatial axis. In direction of a second virtual spatial axis perpendicular to the first spatial axis, the operational axis is spaced from a center of gravity which is formed, for example, by the center of mass of the hand-held power tool, with or without an operational tool fastened thereto. Further, the hand-held power tool has a cover housing which is held at the base housing by flexible decoupling elements which are at least partially spaced from one another with respect to a plane defined by the first and second virtual axis. The cover housing is fixedly connected with the main handle and with side-handle connection means which is formed by fixed connection means in the case of a fixed side handle, and by housing-side connection means in the case of a removable side handle. The housing-side connection means has, for example, a thread or a receiving area for securing a handle-side tensioning belt.

2. Description of the Prior Art

During operation of hand-held power tools of the type mentioned above, due to spacing of the operational axis from the center of gravity, the base housing is subjected to rotational oscillations in opposite directions and which are generated in a rotational direction around the center of gravity in addition to the oscillations along the operational axis. These axial and rotational oscillations can be prevented from being transmitted to the main handle and side handle through the use of a cover housing which is held flexibly on the base housing. The fixed connection of the two handles with the cover housing prevents relative movements between the two handles, and a good handling of the hand-held power tool is ensured in this way. This also yields a relatively large decoupled mass having a positive effect on reducing vibrations between the base housing and the handles.

Vibrations are reduced in all directions by respective suspensions which are largely decoupled from oscillations and which quasi isolate the handle from a large part of the oscillations occurring in operation. Depending on the spring means that is used, there is also provided a damping effect to a degree. This will be referred to concisely hereinafter as decoupling, regardless of the extent of the damping effect.

DE 197 30 356 A1 discloses a hammer drill having a hammer housing at which an outer shell is held so as to enclose it at a distance, this outer shell having a first and second handles. For this purpose, a plurality of flexible articulation points is provided between the hammer drill housing and the outer shell. At these articulation points, a respective shell-side pin engages in a housing-side sleeve with the intermediary of a resiliently flexible material.

This known construction of the decoupling means is intended to achieve a stable guidance and, at the same time, an extensive damping effect in the impact direction.

However, disadvantage of the known hand-held power tool consists in that a sufficient decoupling of the handle from the rotational oscillations of the housing is impossible. Rather, the rotational oscillations are transmitted from the hammer drill housing to the outer shell virtually unimpeded because of the triangular arrangement of the articulation points and the small expansion of the resiliently flexible material acting in the rotating direction at all of the articulation points. Accordingly, a relatively strong vibration still occurs in operation particularly along the second spatial axis.

SUMMARY OF THE INVENTION

It is the object of the present invention to overcome the above-mentioned disadvantages in a hand-held power tool of the type mentioned above and to reduce the vibrations transmitted to the handles as a result of rotational oscillations.

This and other objects of the present invention, which will become apparent hereinafter, are achieved by providing a hand-held power tool in which the decoupling means has in a projection perpendicular to a plane defined by the first and second spatial axis, a first support device which is adjacent to the center of gravity and which supports the cover housing for displacement in a direction of the first spatial axis and also for a pivotal movement in the rotational direction of the rotational oscillations applied to the base housing. The cover housing can be displaced substantially parallel to the first spatial axis and is also pivotable in direction of the first spatial axis by means of the first support device. In every case, apart from this axial displacement, the cover housing is also pivotal parallel to the plane. The term "pivotal" encompasses rotatability or tiltability. The doubly movable support of the cover housing relative to the base housing provides, during an operation, for an effective decoupling of the cover housing, and thus, of both handles, not only of the vibrations acting on the base housing along the first spatial axis, but also of the vibrational components occurring as a result of the rotational oscillations in direction of the second spatial axis. In this way, the transmission of vibrations from the base housing to the handles can be reduced to a minimum, which makes possible a very comfortable operation of the hand-held power tool.

The decoupling means preferably has a first spring device between the base housing and the cover housing, which spring device acts along the first spatial axis. This makes it possible to actively decouple oscillations, which occur along the first spatial axis and to which the base housing is subjected during operation, from the cover housing. This spring device has a first spring stiffness which is greater by a multiple than its transverse stiffness acting tangentially to the rotational oscillation.

Further, in a particularly preferred embodiment of the invention, the decoupling means has a second support device, which is spaced from the first support device and from the first spring device. The second support device has springy means with a first spring stiffness which acts in a rotational direction, in which the rotational oscillations of the base housing are directed, around the center of gravity during operation. The spring stiffness of the springy means is greater by a multiple than a second spring stiffness of the first spring device acting in the rotational direction, insofar as the spring device has a spring stiffness acting in the rotational direction at all. The two support devices and the spring device insure on the one hand, a stable support of the cover housing at the base housing. On the other hand, a sufficient decoupling is ensured irrespective of a point of application of manual force acting on the main handle. Further, an especially good decoupling is achieved as a result of the second support device being spaced from the first support device and from the center of gravity which is adjacent to the latter.

Advantageously, pivotal means which is spaced from the center of gravity along the first spatial axis by a distance amounting to at most 0.4-times the distance of the center of gravity from a back side of the base housing, is provided on the first support device. Accordingly, the rotational oscillations of the base housing, which are generated around the center of gravity during an operation, are decoupled from the cover housing in a particularly effective manner.

It is particularly advantageous when the pivotal means has an active pivotal or rotational axis which is located between the center of gravity and the operational axis in relation to the second spatial axis. This ensures a relative movement between the cover housing and the base housing that is particularly advantageous for the decoupling.

At least one of the support devices preferably has decoupling means which is arranged in pairs and which is spaced from a third spatial axis that extends perpendicular to the plane defined by the first and second spatial axis. As a result of these decoupling means being spaced from one another along the third spatial axis, a support of the cover housing on the base housing with particularly good lateral stability can be achieved during operation, and a good guidance of the hand-held power tool can be ensured. Alternatively, the support devices can also be provided on one side, respectively, given a correspondingly stable construction.

In an advantageous embodiment of the invention, a pin that is connected to one of the two housings, is provided between the base housing and the cover housing. This pin is displaceable along a guide which is provided on the other respective housing and which is oriented along the first spatial axis, and is rotatable relative to this guide. Accordingly, in addition to a rotational support which is substantially free of resistance, a support of the cover housing, which is also substantially free of resistance in the axial direction is achieved. In this way, a particularly good decoupling is also possible with respect to the axial oscillations along the first spatial axis.

It is advantageous when the guide is formed by an elongate hole in the cover housing, and the pin is connected to a portion of the base housing that receives the transmission unit, so that the first support device is especially stable and can be produced economically.

The guide is advantageously formed so as to be curved relative to the first spatial axis. Thereby, a particularly low-resistance rotational oscillation of the cover housing relative to the base housing is possible.

Further, it is advantageous when the spring device has spring means that presses against the pin. In this way, the first support device and the spring device can be arranged in a common area, which reduces the total installation space required for the decoupling means. Further, with the arrangement of the spring means directly on the pin which acts as part of a hinge support, the spring means can be prevented from deflecting along the second spatial axis so that an improved decoupling of the cover housing in the rotational direction can be achieved by means of the second support device.

In an alternative advantageous embodiment of the invention, the first support device has an articulated arm having a first pivotal connection with the base housing and a second pivotal connection with the cover housing. In this way, the support of the cover housing on the base housing, which is pivotable in the rotational direction so as to be substantially free of resistance, is achieved at the first support device, which makes possible a particularly good decoupling of the cover housing from rotational oscillations and prevents a spring stiffness acting in the rotational direction around the center of gravity.

In another preferred embodiment of the invention, the first support device has leaf spring means which is elastically deformable between the base housing and the cover housing in direction of the first spatial axis and in the rotational direction, which allows the first support device to be produced in an economical manner.

It is particularly advantageous when the leaf spring means is formed in one piece by a U-shaped leaf spring element which engages around the base housing at the height of the operational axis. Accordingly, the first support device can be produced economically and is easy to assemble.

Further, it is advantageous when sliding surfaces which cooperate with counter-sliding surfaces of the base housing are provided on the cover housing. The sliding surfaces and counter-sliding surfaces extend parallel to the plane defined by the first and second spatial axis. A particularly stable lateral guidance of the cover housing over the base housing can be insured in this way in a smallest possible installation space.

In this regard, means, e.g., in the form of elastomer bodies, can also be provided at the sliding surfaces and act in a springy manner along the third spatial axis and accordingly enable decoupling in all spatial directions.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
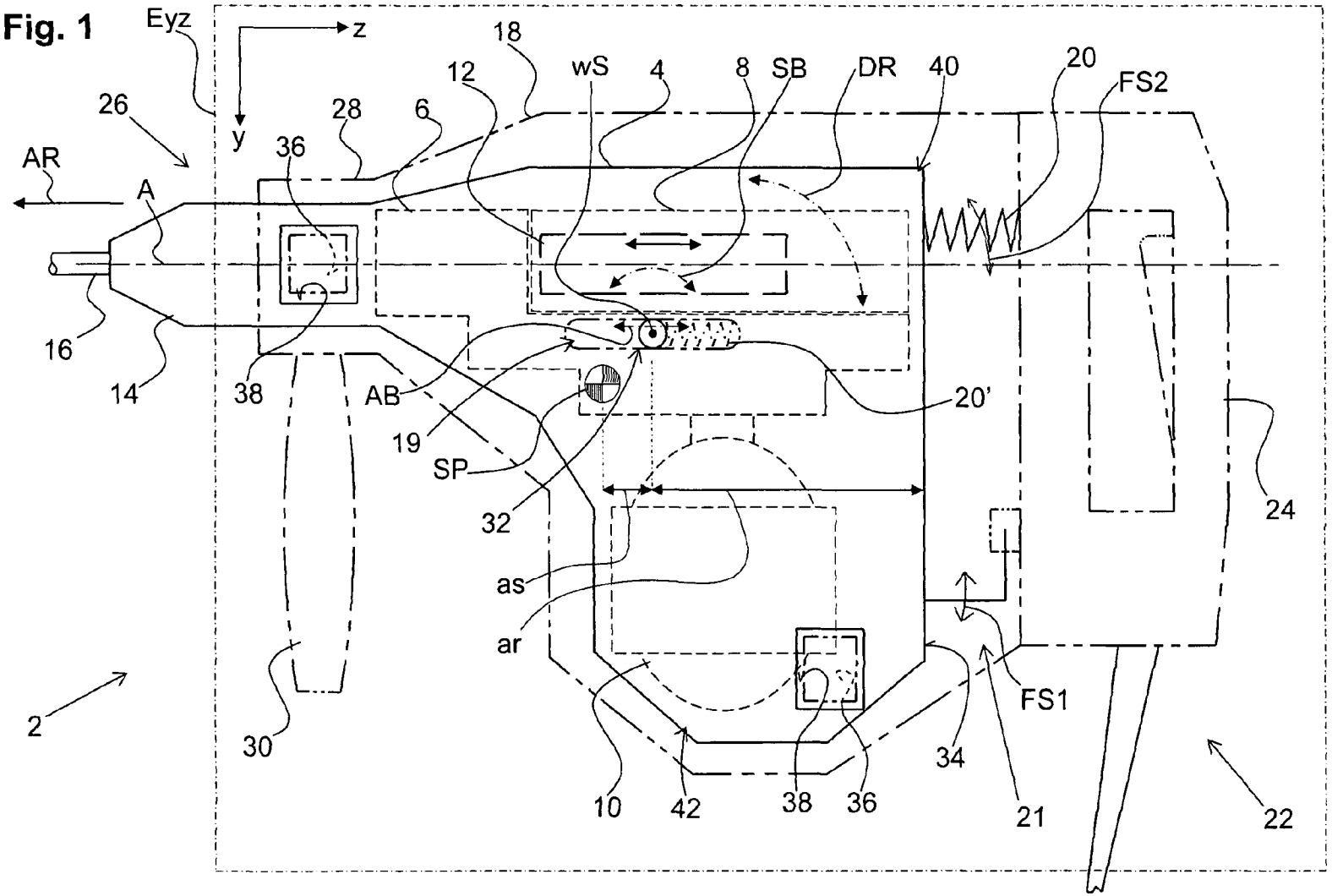
FIG. 1 a side view of a hand-held power tool according to the present invention.

FIG. 1 shows a hand-held power tool 2 in the form of a hammer drill. The hand-held power tool 2 has a base housing 4 in which are accommodated a transmission arrangement 6 and an impact device 8 which can be driven by a motor 10 in a manner not shown in more detail. Operational means 12 in the form of a percussion piston reciprocates along an operational axis A defining a first spatial axis z. The operational means 12 serves to repeatedly apply impact energy to a working tool 16 in the form of a drill which is held in a tool receptacle 14.

The base housing 4 is almost completely enclosed by a cover housing 18 which is held on the base housing 4 at a distance from the latter by a first support device 19, a spring device 20; 20' and a second support device 21 serving as decoupling means. This cover housing 18 forms a main handle 24 at the rear end 22, with reference to an operational direction AR, of the hand-held power tool 2. Further, at the front end 26, with reference to operational direction AR, the cover housing 18 has side-handle connection means 28 in the form of a cylindrical receiving surface to which a side handle 30 can be fixed if required.

The entire hand-held power tool 2 with the working tool 16 fastened thereto has a center of gravity SP which is spaced from axis A in relation to a second spatial axis y perpendicular to the first spatial axis z. Accordingly, a rotational movement is generated in a rotational direction DR around the center of gravity SP in operation during the reciprocating movement of the operational means 12, this rotational direction DR extending parallel to a plane Eyz defined by the first spatial axis z and the second spatial axis y.

In order to ensure an optimal decoupling of the handles 24, 30 along the first spatial axis z and, therefore, in operational direction AR during operation, an axial reciprocating movement of the base housing 4 relative to the cover housing 18 which is directed substantially along the first spatial axis z is made possible by the first support device 19 as is indicated by movement arrow AB.

At the same time, the first support device 19 makes possible a relative movement of the cover housing 18 relative to the base housing 4 approximately in the rotational direction DR in operation and accordingly decouples the cover housing 18 from the rotational oscillations of the base housing 4 and from the vibrations measurable in direction of the second spatial axis y. To this end, the first support device 19 is arranged adjacent to the center of gravity SP and has means, designated generally as pivotal means 32, for the pivotal support and rotational support forming an effective pivotal axis wS. This makes possible a relative pivotal movement or rotational movement of the base housing 4 relative to the cover housing 18 along the plane Eyz which is indicated by the movement arrow SB. In this way, the rotational oscillations occurring in operation around the center of gravity SP can be decoupled particularly effectively from the cover housing 18 when an axial distance (as) of the pivotal means 32 from the center of gravity SP in relation to the first spatial axis z is not greater than 0.4-times an axial distance (ar) of the pivotal means SP from a rear side 34 of the base housing 4 facing the rear end 22.

Further, as can be seen from FIG. 1, the spring device 20 is formed, for example, by a helical spring and supports the cover housing 18 in direction of the first spatial axis z at an upper portion 40 of the base housing 4 receiving the impact device 8. As is shown by the dash-dot line, the spring device 20' can also act on the pivotal means 32 directly. At the same time, the second support device 21 is formed, for example, by a bent leaf spring which functions at the same time as a hinge support and spring means. Alternatively, separate means can also be used to ensure the pivotal support function and the spring function of the second support device 21.

The second support device 21 is arranged between a lower part 42 of the base housing 4 that receives the motor 10, and the cover housing 18 at a distance from the first support device 19 and from the spring device 20; 20'. The second support device 21 has a first spring stiffness FS1 which acts in the rotational direction DR and which in every case is higher by a multiple than a second spring stiffness FS2 of the spring device 20; 20' acting in the rotational direction.

In the present example, the second spring stiffness FS2 approaches zero because the helical spring is oriented substantially transverse to rotational direction DR. Further, forces or torques acting at the first support device 19 in the rotational direction DR are substantially eliminated by the pivotal means 32. Accordingly, the rotational oscillation generated in operation around the center of gravity SP is substantially absorbed by the second support device 21 and decoupled from the cover housing 18.

As can further be seen from FIG. 1, a plurality of sliding surfaces 36 which contact corresponding counter-sliding surfaces 38 of the base housing 4 along a third spatial axis x extending perpendicular to the plane Eyz are formed at the cover housing 18. By means of the sliding surfaces 36 and the counter-sliding surfaces 38, the cover housing 18 is supported in direction of the third spatial axis x on both sides at the base housing 4, while it can be displaced parallel to the plane Eyz. Springing means can be provided at the sliding surfaces 36 or counter-sliding surfaces 38, or the sliding surfaces 36 or counter-sliding surfaces 38 can themselves be formed by springing means such as, for example, elastomer bodies in order to make possible a decoupling along all three spatial axes (z, y, x).

Figure 2:
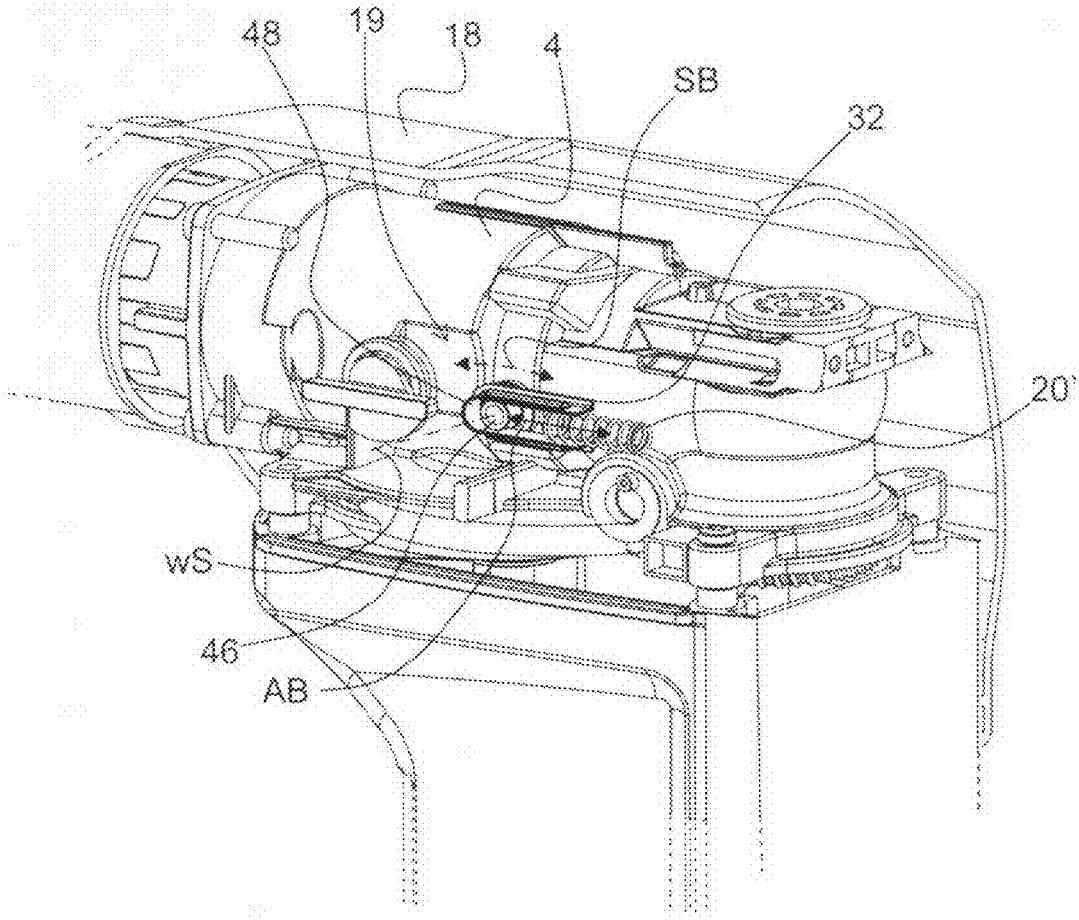
FIG. 2 a perspective view of a first support device of the hand-held power tool shown in FIG. 1.
Figure 3:
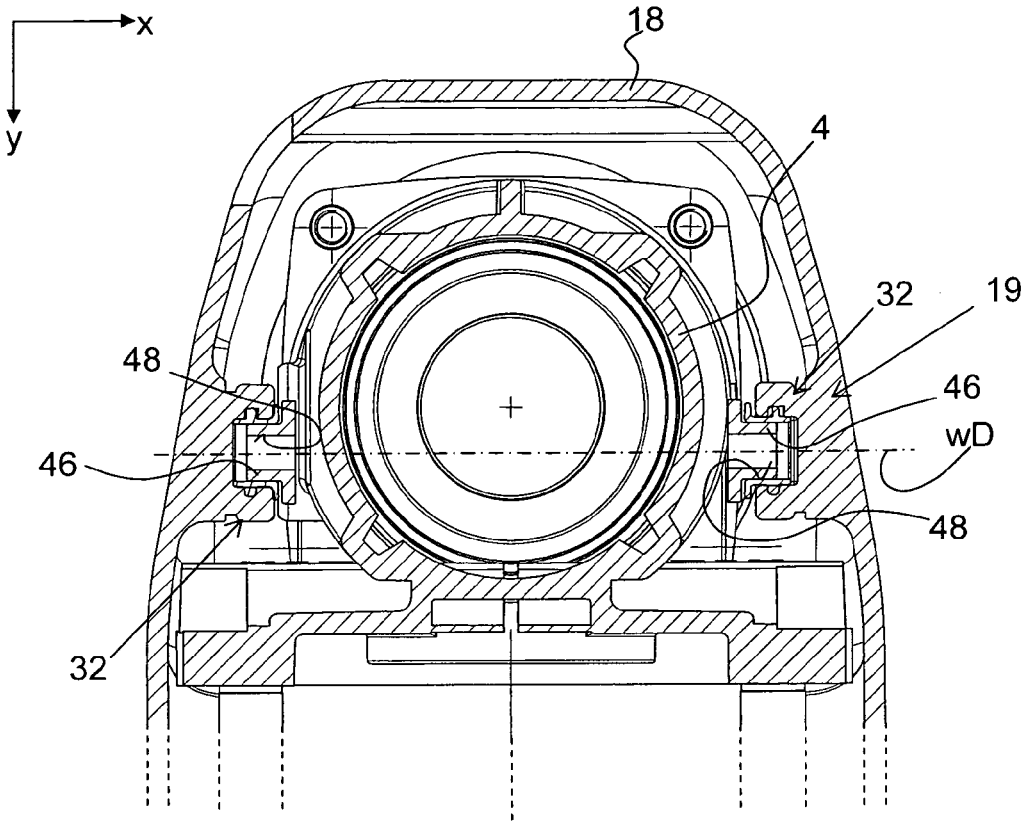
FIG. 3 a cross-sectional view of the first support device FIG. 2.

FIGS. 2 and 3 show a first embodiment of the first support device 19 in which the spring device 20' acts directly on the pin 46, for example. The pivotal means 32 are formed by two pins 46 which project from the base housing 4 at opposite sides of the base housing 4 along the third spatial axis x and are rotatable, respectively, in a guide 48. The two guides 48 are oriented along the first spatial axis z and are formed at the cover housing 18, for example, as elongated holes. Alternatively, the guides 48 can also be formed at the base housing 4, while the pins 46 project inward from the cover housing 18. Further, it is also possible that the guides 48 are formed by slotted links, not shown, which are curved.

Figure 4:
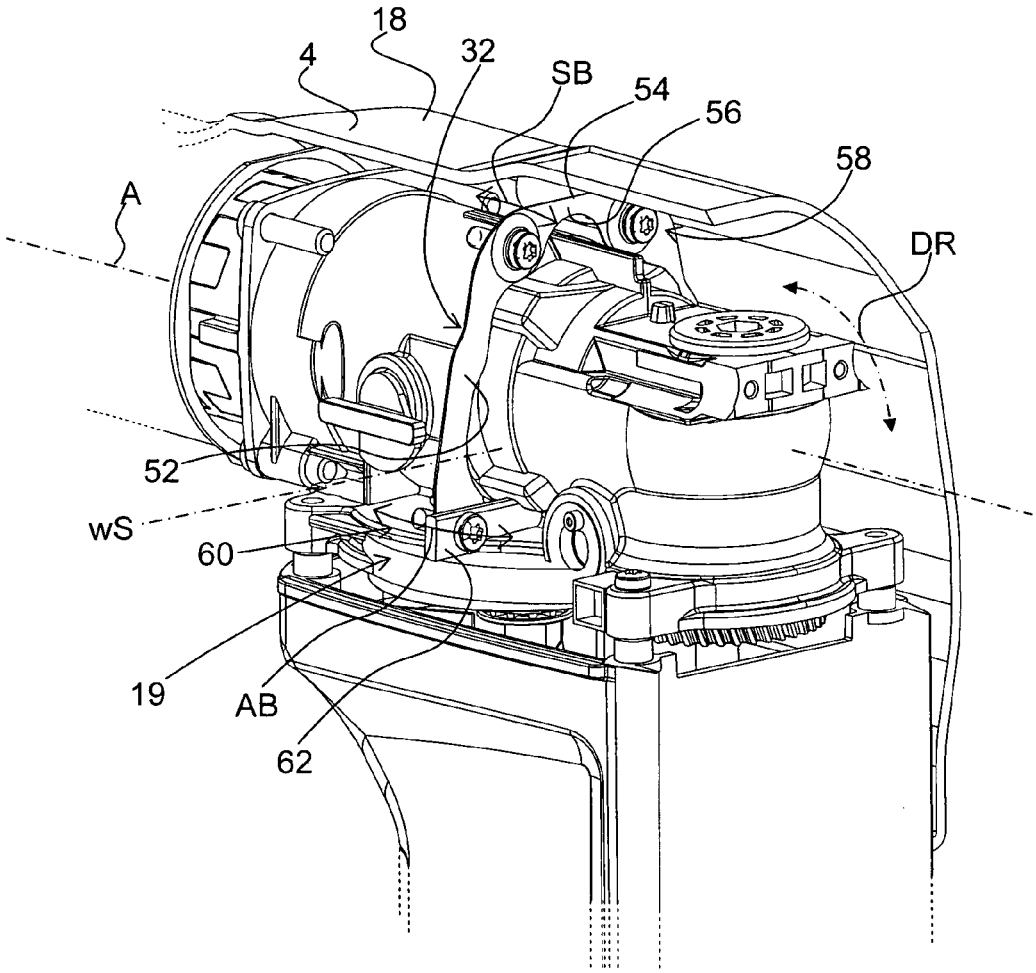
FIG. 4 a perspective view of an alternative embodiment form of the first support device.
Figure 5:
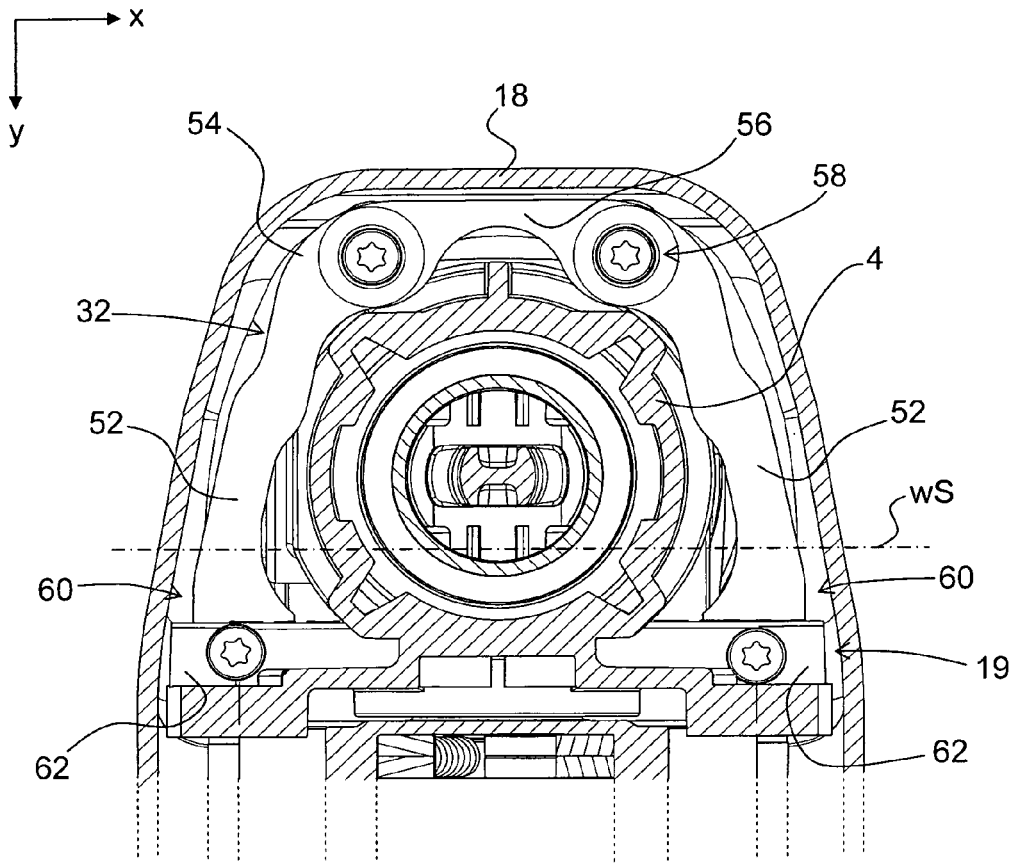
FIG. 5 a cross-sectional view of the alternative embodiment of the support device shown in FIG. 4.

FIGS. 4 and 5 shows another alternative embodiment of the first support device 19, wherein elements having the same function are provided with corresponding reference numerals according to the embodiment form in FIGS. 2 and 3.

The pivotal means 32 are formed by webs 52 of a leaf spring element 54 which is U-shaped and extends around the base housing 4 at the height of axis A. In a middle area 56 connecting the two webs 52, the leaf spring element 54 is fastened to the cover housing 18 by means of a screw connection 58. The webs 52, on the other hand, are fixed at a respective free end 60 at corresponding receptacles 62 of the base housing 4. Accordingly, the elastic deformability of the leaf spring element 54 makes possible a pivotal movement which is substantially positionally stable with respect to the first spatial axis z and which has an axial movement component as is indicated by movement arrow AB. Further, a pivotal movement SB around an active pivotal axis wS defined by the leaf spring element 54 is also possible. The pivotal movement SB is effected approximately in the rotational direction DR of the rotational oscillations generated in operation.

Figure 6:
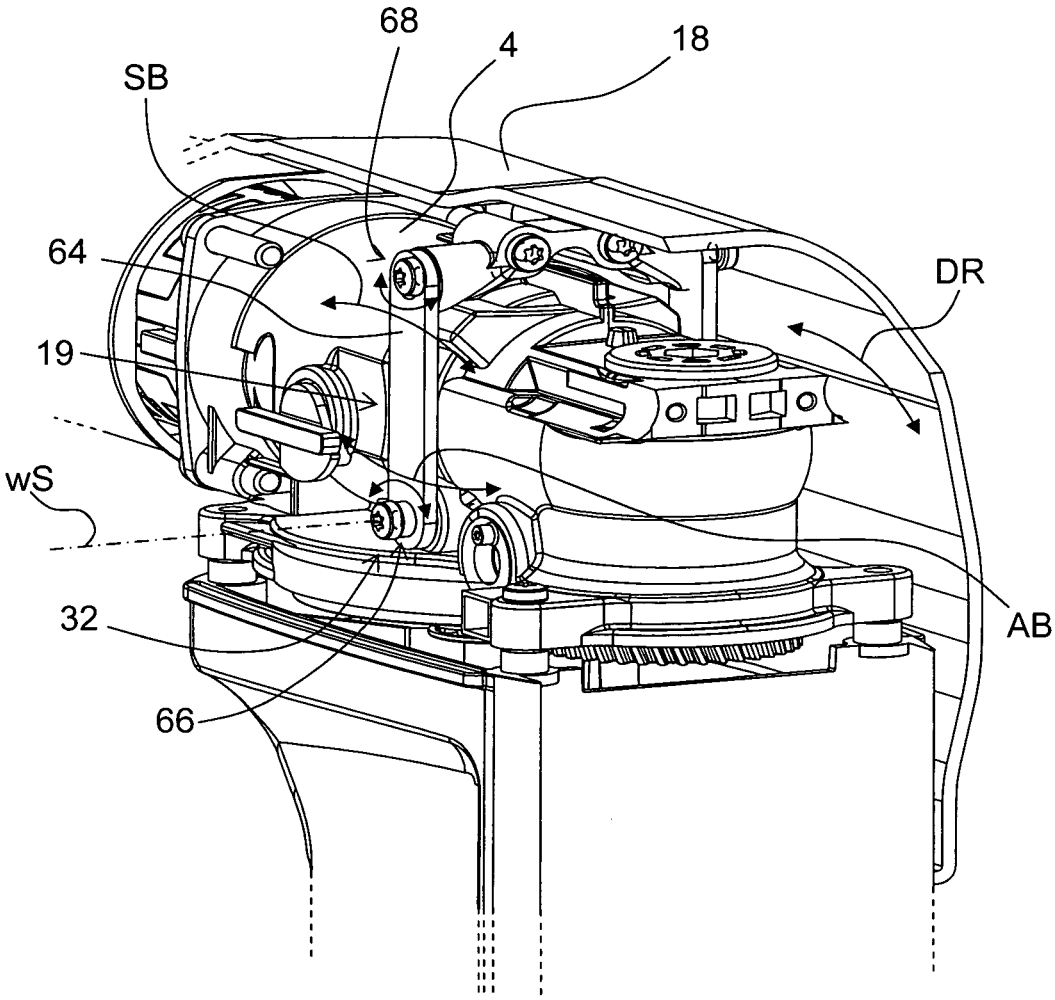
FIG. 6 a perspective view of another alternative embodiment of the first support device.
Figure 7:
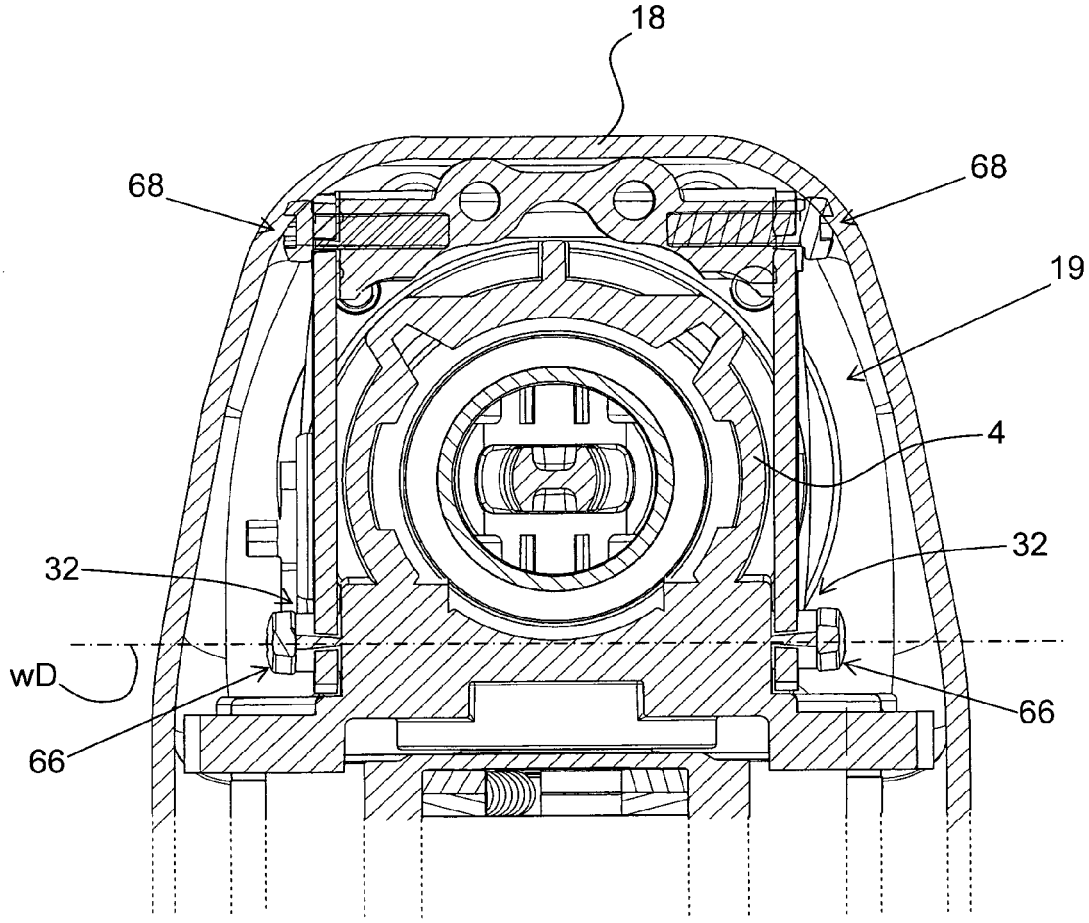
FIG. 7 a cross-sectional view of another alternative embodiment of the support device shown in FIG. 6.

FIGS. 6 and 7 show another alternative embodiment of the first support device 19, wherein elements having the same function have reference numerals corresponding to the embodiment according to FIGS. 2 to 5.

The pivotal means 32 are formed by two articulated arms 64. These articulated arms 64 are spaced from one another in direction of the third spatial axis x at opposite sides of the base housing 4 and have, respectively first rotational connection means 66 to the base housing 4 and second rotational connection second 68 to the cover housing 18. This construction of the first support device 19 makes possible a pivotal movement between the base housing 4 and the cover housing 18, which pivotal movement is positionally stable with respect to the first spatial axis z and has a substantially axial movement component as is indicated by movement arrow AB, as well as a pivotal movement SB around the active pivotal axis wS which is defined by the rotational connection 66.

Though the present invention was shown and described with references to the preferred embodiments, such are merely illustrative of the present invention and are not to be construed as a limitation thereof, and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A hand-held power tool, comprising:

a base housing (4);

a percussion piston (12) located in the base housing (4) and reciprocating during an operation of the power tool (2) along an operational axis (A) that defines a first spatial axis (z) and is spaced from a gravity center (SP) of the power tool (2) in a direction of a second spatial axis (y) which is perpendicular to the first spatial axis (z);

a cover housing (18) fixedly connected with a main handle (24) and having a receiving surface (28) for connecting a side handle; and decoupling means for supporting the cover housing (18) on the base housing (4) and having a support device (19) arranged adjacent to the gravity center (Sp) in a projection extending perpendicular to a plane (Eyz) defined by the first and second spatial axis (z, y) for supporting the cover housing (18) on the base housing (4) for displacement of the cover housing (18) in a direction of the first spatial axis (z) and for displacement of the cover housing (18) in a pivotal direction (SB) independently of displacement of the cover housing (18) in the first spatial axis (z) direction.

2. A hand-held power tool according to claim 1, wherein the decoupling means comprises a spring device (20; 20') located between the base housing (4) and the cover housing (18) and acting along the first spatial axis (z).

3. A hand-held power tool according to claim 2, wherein the decoupling means further comprises a further device (21) spaced from the support device (19) and from the spring device (20; 20'), and wherein the further support device (21) has a spring stiffness (FS1) which acts in a rotational direction or in which rotational oscillations of the base housing (4) are directed and which is greater by a multiple than a spring stiffness (FS2) of the spring device (20; 20') acting in the rotational direction.

4. A hand-held power tool according to claim 1, wherein the support device (19) has pivotal means (32) spaced by a distance (as) from the center of gravity (SP) along the first spatial axis (z) and amounting to at most 0.4-times the distance (ar) of the center of gravity (SP) from a back side (34) of the base housing (4).

5. A hand-held power tool according to claim 4, wherein the pivotal means (32) have an active pivotal axis (wS) which is located between the center of gravity (SP) and the operational axis (A) in relation to the second spatial axis (y).

6. A hand-held power tool according to claim 3, wherein at least one of the support device (19) and the further support device (21) has decoupling elements which are arranged in pairs and which are spaced from one another with respect to a third spatial axis (x) perpendicular to the plane (Eyz) defined by the first and second spatial axis (z, y).

7. A hand-held power tool according to claim 1, wherein a pin (46) is provided between the base housing (4) and the cover housing (18) and is connected to one of the base and cover housings (4; 18), and wherein the pin (46) is displaceable along a guide (48) provided at another of the base and cover housings (18; 4) and is rotatable relative to it.

8. A hand-held power tool according to claim 7, wherein the guide (48) is formed as an elongate hole in the cover housing (18), and the pin (46) is connected to a portion of the base housing (4) that receives a transmission unit (6).

9. A hand-held power tool according to claim 7, wherein the guide (48) is curved relative to the first spatial axis (z).

10. A hand-held power tool according to claim 2, wherein the spring device (20; 20') has spring means for pressing directly against the pin (46).

11. A hand-held power tool according to claim 1, wherein the support device (19) has an articulated arm (64) having a first rotational connection (66) with the base housing (4) and a second rotational connection (68) with the cover housing (18).

12. A hand-held power tool according to claim 1, wherein the support device (19) has leaf spring means which are elastically deformable between the base housing (4) and the cover housing (18) along the first spatial axis (z) and in a rotational direction (DR).

13. A hand-held power tool according to claim 12, wherein the leaf spring means is formed by a U-shaped leaf spring element (54) which engages around the base housing (4) at a height of the operational axis (A).

14. A hand-held power tool according to claim 1, wherein sliding surfaces (36) which cooperate with counter-sliding surfaces (38) of the base housing (4) are provided on the cover housing (18), and wherein the sliding surfaces (36) and counter-sliding surfaces (38) extend parallel to the plane (Eyz).

15. A hand-held power tool according to claim 14, wherein means, which act in a springing manner along the third spatial axis (x) are provided at the sliding surfaces (36).

16. A hand-held power tool, comprising:

a base housing (4);

a percussion piston (12) located in the base housing (4) and reciprocating during an operation of the power tool (2) along an operational axis (A) that defines a first spatial axis (z) and is spaced from a gravity center (SP) of the power tool (2) in a direction of a second spatial axis (y) which is perpendicular to the first spatial axis (z);

a cover housing (18) fixedly connected with a main handle (24) and having a receiving surface (28) for connecting a side handle; and decoupling means for supporting the cover housing (18) on the base housing (4) and having a support device (19) arranged adjacent to the gravity center (Sp) in a projection extending perpendicular to a plane (Eyz) defined by the first and second spatial axis (z, y) for supporting the cover housing (18) on the base housing (4) for displacement of the cover housing (18) in a pivotal direction (SB) and for displacement of the cover housing (18) in a direction of the first spatial axis (z) independently of displacement of the cover housing (18) in the pivotal direction (SB).

* * * * *